US005258703A

United States Patent [19]

Pham et al.

[11] Patent Number: 5,258,703

[45] Date of Patent: Nov. 2, 1993

[54] TEMPERATURE COMPENSATED VOLTAGE REGULATOR HAVING BETA COMPENSATION

[75] Inventors: Phuc C. Pham, Chandler; Lou Spangler; Greg Davis, both of Mesa, all of Ariz.

[73] Assignee: Motorola, Inc., Schaumburg, Ill.

[21] Appl. No.: 923,638

[22] Filed: Aug. 3, 1992

[51] Int. Cl.[5] ..... G05F 3/16

[52] U.S. Cl. ..... 323/313; 323/907

[58] Field of Search ..... 323/313, 314, 907

[56] References Cited

U.S. PATENT DOCUMENTS 3,648,153 3/1972 Graf ..... 323/907
3,781,648 12/1973 Owens ..... 323/907
3,820,007 6/1974 Schilling et al. ..... 323/313
4,390,829 6/1983 Jarrett ..... 323/313
4,675,592 6/1987 Tsuzuki ..... 323/313
4,843,303 6/1989 Shoji ..... 323/314

*Primary Examiner*—Jeffrey Sterrett
*Attorney, Agent, or Firm*—Michael D. Bingham

[57] ABSTRACT

A temperature compensated voltage regulator circuit having a first resistor ($R_X$) disposed in the base circuit between two cascaded transistors and a second resistor ($R_F$) coupled between the collector and base of the first of the two transistors to provide compensation for beta variations in the transistors resulting from process variables during the manufacture of the circuit.

5 Claims, 2 Drawing Sheets

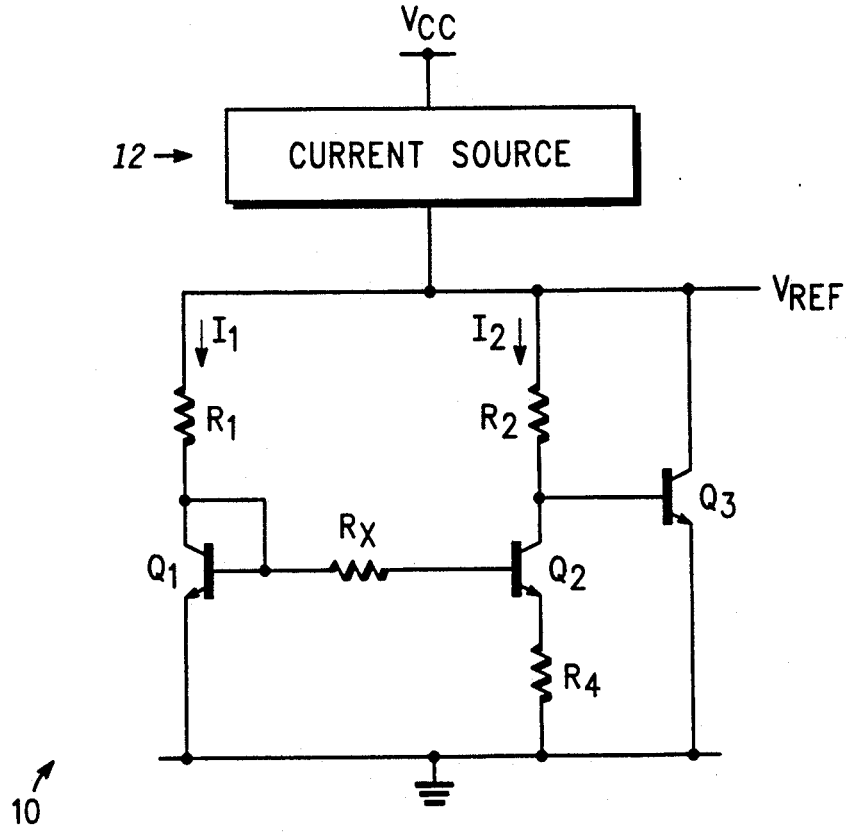
FIG. 1
-PRIOR ART-
FIG. 2
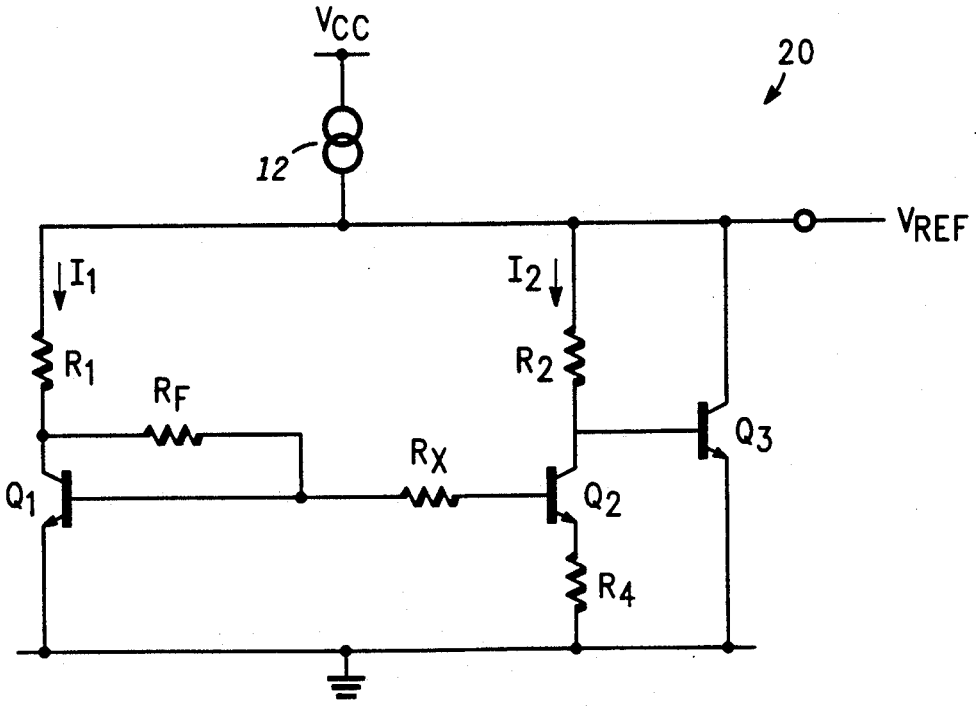

TEMPERATURE COMPENSATED VOLTAGE REGULATOR HAVING BETA COMPENSATION

BACKGROUND OF THE INVENTION

The present invention relates to reference voltage supply circuits for providing a regulated direct current output voltage and, more particularly, to a temperature compensated integrated voltage regulator circuit including means for compensating beta variations in transistor elements comprising the circuit due to semiconductor process variations.

Integrated temperature compensated regulator circuits for providing a D.C. voltage reference that can be utilized to bias ECL circuits, for instance, are well known in the art. Temperature compensation is provided by operating a pair of transistors at different current densities to establish a difference in the base-emitter voltages, $\Delta V_{BE}$, between the emitters of the two transistors and establishing a current therefrom having a positive temperature coefficient. This current is then utilized to produce a voltage in series with the negative temperature coefficient of the base-emitter voltage of a third transistor to establish the temperature compensated reference voltage.

U.S. Pat. No. 3,781,648 discloses a voltage regulator of the above mentioned type further including means for compensating for variations in beta of the transistor elements incurred as a result of process variations in the integrated circuit fabrication processes. As will be more fully explained later, this circuit is comprised of a resistor disposed in the base circuit between the first and second transistors that are operated at different current densities to reduce variations of the reference voltage as the beta of the transistors varies due to process variations, which in turn causes the $V_{BE}$ and base currents of the transistors to vary.

Although the aforementioned regulator works quite well, there is a need for a similar type regulator having improved beta compensation means required in today's higher performance circuit designs.

SUMMARY OF THE INVENTION

Accordingly, there is provided a temperature compensated voltage regulator comprising an output at which a reference voltage is established and first and second series circuits coupled to the output wherein the first circuit includes a first resistor in series with the main electrodes of a first transistor and the second circuit includes second and third resistors in series with the main electrodes of a second transistor; and fourth and fifth resistors for compensating for process variations of beta wherein the fifth resistor is coupled between the control electrodes of the two transistors and the fourth resistor is coupled between the first resistor and the control electrode of the first transistor.

BRIEF DESCRIPTION OF THE DRAWING

FIG. 1 is a simplified schematic diagram illustrating a prior art temperature compensated regulator circuit having beta compensation;

FIG. 2 is a schematic diagram illustrating the regulator circuit of the preferred embodiment.

DETAILED DESCRIPTION OF THE PREFERRED EMBODIMENT

Figure 3:
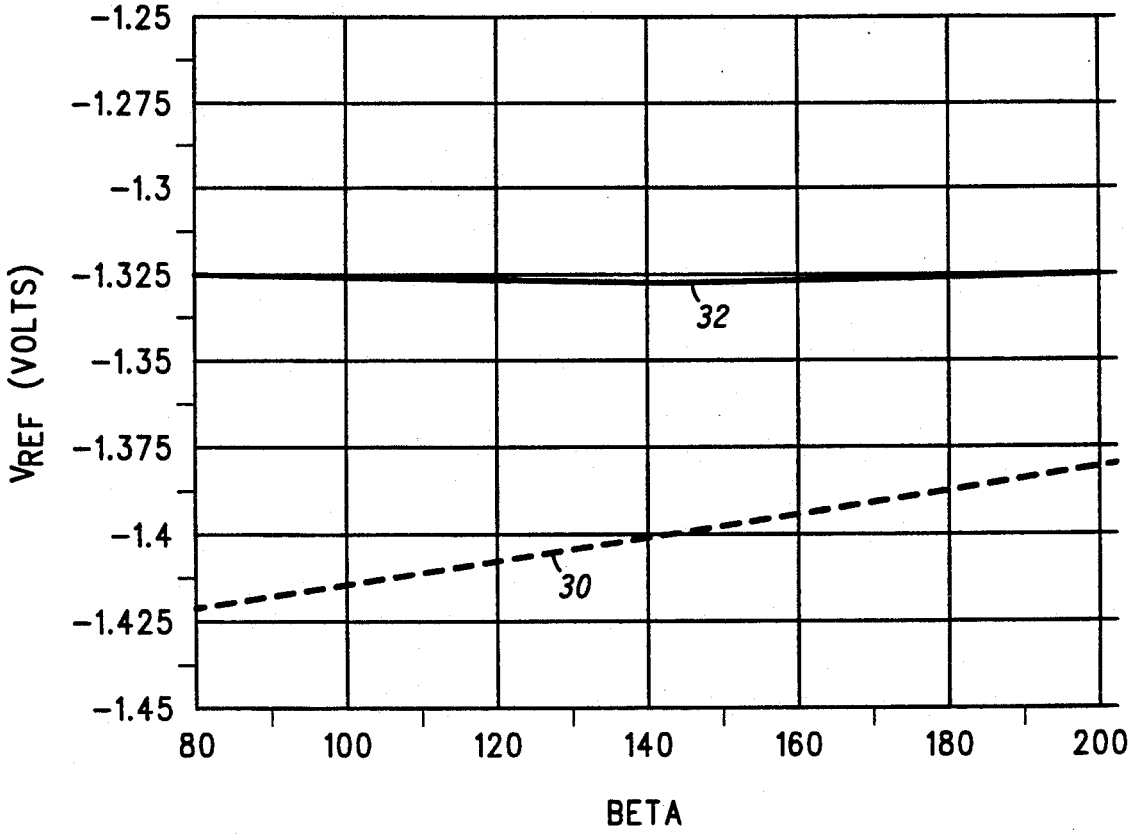
FIG. 3 is a diagram illustrating the relative variations in the output voltage of the circuits of FIGS. 1 and 2 due to variations in beta of the transistor elements comprising the same.

Turning to FIG. 1 there is shown and described prior art temperature compensated regulator circuit 10 having beta compensation. Regulator 10 is coupled between first and second power supply conductors to which $V_{CC}$ and ground reference potentials are applied and comprises a current source 12, i.e. a resistor, coupled between $V_{CC}$ and an output terminal at which $V_{REF}$ is produced. A first series circuit comprising resistor $R_1$ and diode-connected transistor $Q_1$ is coupled between $V_{REF}$ output terminal and ground while a second series circuit comprising resistor $R_2$, $R_4$ and transistor $Q_2$ is also coupled between $V_{REF}$ output and ground. Beta compensation is provided by resistor $R_X$ coupled between the base circuits of cascaded transistor $Q_1$ and $Q_2$.

To the first order, with $I_1$ equal to $I_2$, the following equations can be established:

$$I_1 R_1 = V_{REF} - V_{BEQ1} \quad (1)$$

and $$I_2 = (V_{BEQ1} - I_{B2}R_X - V_{BEQ2})/R_4 - I_{B2} \quad (2)$$

where $I_{B2}$ is the base current of $Q_2$ and $V_{BEQ1}$, and $V_{BEQ2}$ are the base-emitter voltages of $Q_1$ and $Q_2$ respectively.

If $R_1$ and $R_2$ are of same value and assuming the base currents of the two transistors are very small as compared to the collector currents, then:

$$I_1 R_1 = I_2 R_2 \quad (3)$$

substituting equations (1) and (2) into (3) gives:

$$V_{REF} - V_{BEQ1} = (V_{BEQ1} - I_{B2}R_X - V_{BEQ2})R_2/R_4 - I_{B2}R_2$$

or $$V_{REF} = (R_2/R_4 + 1)V_{BEQ1} - (R_2/R_4)V_{BEQ2} - (R_X/R_4 + 1)I_{B2}R_2. \quad (4)$$

For $V_{REF}$ to be constant with variations in beta, then the derivative of equation (4) with respect to $V_{BE}$ and $I_B$ should be zero. Hence:

$$\partial V_{REF}/\partial V_{BE} + \partial V_{REF}/\partial I_B = 0.$$

Thus;

$$\partial V_{REF}/\partial V_{BE} = (R_2/R_4 + 1)\Delta V_{BEQ1} - (R_2/R_4)\Delta V_{BEQ2} \quad (5)$$

$$\partial V_{REF}/\partial I_B = -R_2(R_X/R_4 + 1)\,\Delta I_{B2} \quad (6)$$

further, from equation (6), it is recognized that the variation of $V_{REF}$ due to variation of beta is reduced in the prior art regulator by the negative term associated with variations in base current, $I_{B2}$, of transistor $Q_2$. Hence, the addition of $R_X$ provides improvement in variations of the reference voltage $V_{REF}$ due to process variations in the manufacture of integrated circuits which is indicated by wave form 30 of FIG. 3.

As understood, the difference in the base-emitter voltage established between Q1 and transistor Q2 produces a $\Delta V_{BE}$ positive temperature coefficient potential across $R_4$ such that $I_2$ also has a positive temperature coefficient. Hence, the potential developed across $R_2$ will have a positive temperature coefficient which combined in series with the negative temperature coefficient of the base-emitter voltage of $Q_3$ results in $V_{REF}$ having a known temperature coefficient; typically zero.

While the aforedescribed prior art regulator provides means ($R_X$) to compensate for beta variations of the transistors due to process variations, greater improvement is required in higher performance regulator circuit designs necessitated in today's environment.

Turning now to FIG. 2, temperature compensated regulator circuit 20 having improved beta compensation in accordance with the preferred embodiment will be described that is suited to be manufactured in integrated circuit form. Regulator 20 includes additional beta compensation means for further reducing variations of $V_{REF}$ caused by process variations of $V_{BE}$. Regulator circuit 20 operates in substantially the similar manner as regulator 10 described above but has improved beta compensation resulting from the addition of resistor $R_F$ between the collector and base of transistor $Q_1$ as will be shown hereinafter. It is noted that like components of FIG. 2 with respect to FIG. 1 share common reference numbers.

In a similar manner as previously shown, the following equations can be written for regulator 20:

$$V_{REF}=(R_2/R_4+1)V_{BEQ1}-(R_2/R_4)\cdot V_{BEQ2}-(R_2R_X/R_4+R_2-R_F)I_{B2}+R_FI_{B1} \quad (7)$$

again, by differentiating equation 7 gives:

$$\partial V_{REF}/\partial V_{BE}=(R_2/R_4+1)\Delta V_{BEQ1}-(R_2/R_4)\Delta\cdot V_{BEQ2} \quad (8);$$

and $$\partial V_{REF}/\partial I_B=-R_2(R_X/R_4+1)\Delta I_{B2}+R_F(\Delta I_{B1}\cdot+\Delta I_{B2}) \quad (9).$$

Comparing equations 8 and 9 to equations 5 and 6 shows a reduction in $V_{REF}$ variation due to beta process variations is improved in regulator 20 by the additional term $R_F(\Delta I_{B1}+\Delta I_{B2})$: this is a significant improvement over the prior art regulator circuit of FIG. 1. This improvement is shown in the comparative graphs of FIG. 3. Wave form 30 represents the variation of $V_{REF}$ as beta varies for prior art regulator circuit 10 while wave form 32 show the same for regulator circuit 20.

Hence, what has been described above is a novel regulator circuit having improved beta compensation over the prior art for eliminating or at least severely limiting the effects of process variations on the regulated output voltage of the circuit.

What is claimed is:

1. A temperature compensated voltage regulator having beta compensation, comprising:

first and second power supply conductors for receiving an operating bias potential;

a terminal at which a reference potential is developed;

a current source coupled between said first power supply conductor and said terminal;

first circuit means forming a first series circuit coupled between said terminal and said second power supply conductor including a first transistor having first and second electrodes and a control electrode and first resistive means coupled in series with said terminal and second electrode of said first transistor;

second circuit means forming a second series circuit coupled between said terminal and said second power supply conductor including a second transistor having first and second electrodes and a control electrode, a second resistive means coupled in series with said second electrode of said second transistor, and a third resistive means coupled in series with said first electrode of said second transistor;

first beta compensation means coupled between said control electrodes of said first and second transistors;

second beta compensation means coupled between said second and control electrodes of said first transistor; and third transistor means having first and second electrodes coupled in series with said terminal and said second power supply conductor and a control electrode coupled to said second electrode of said second transistor.

2. The voltage regulator of claim 1 wherein said first beta compensation means includes a first resistor.

3. The voltage regulator of claim 2 wherein said second beta compensation means includes a second resistor.

4. The voltage regulator of claim 1 wherein said first beta compensation means includes a first resistor.

5. The voltage regulator of claim 4 wherein said second beta compensation means includes a second resistor.

* * * * *